United States Patent [19]

Kovar

[11] 3,998,247

[45] Dec. 21, 1976

[54] DEVICE FOR COMPENSATING THE LENGTH OF BINDING THREADS IN A ROTARY SHEDDING DEVICE

[75] Inventor: Stanislav Kovar, Vsetin, Czechoslovakia

[73] Assignee: Zbrojovka Vsetin, narodni podnik, Vsetin, Czechoslovakia

[22] Filed: Apr. 9, 1975

[21] Appl. No.: 566,411

[30] Foreign Application Priority Data

Apr. 11, 1974 . Czechoslovakia ..... 2606-74

[52] U.S. Cl. ..... 139/54

[51] Int. Cl.[2] ..... D03C 11/00

[58] Field of Search ..... 139/48, 50, 54, 122 S

[56] References Cited

UNITED STATES PATENTS 3,698,441 10/1972 Mullekom ..... 139/54

FOREIGN PATENTS OR APPLICATIONS 619,979 1/1927 France ..... 139/50

1,082,348 9/1967 United Kingdom ..... 139/54

*Primary Examiner*—Henry S. Jaudon

[57] ABSTRACT

Device for compensating the length of binding threads in a rotary entangling device used for reinforcing the fabric selvedge by twisted leno, particularly for an entangling device of the type in which the bobbins with the binding threads are spaced apart from the twisting disc and which serve only for forming a shed of binding threads. The rotation of the twisting disc is synchronized with that of the device on which said bobbins are mounted. The twisting disc has two guiding channels therein in the form of slots arranged symmetrically to the axis of rotation of the twisting disc and situated in the circumference of a circle the diameter of which substantially corresponds to the magnitude of the warp thread shed at a given distance of the twisting disc from the binding point.

2 Claims, 11 Drawing Figures

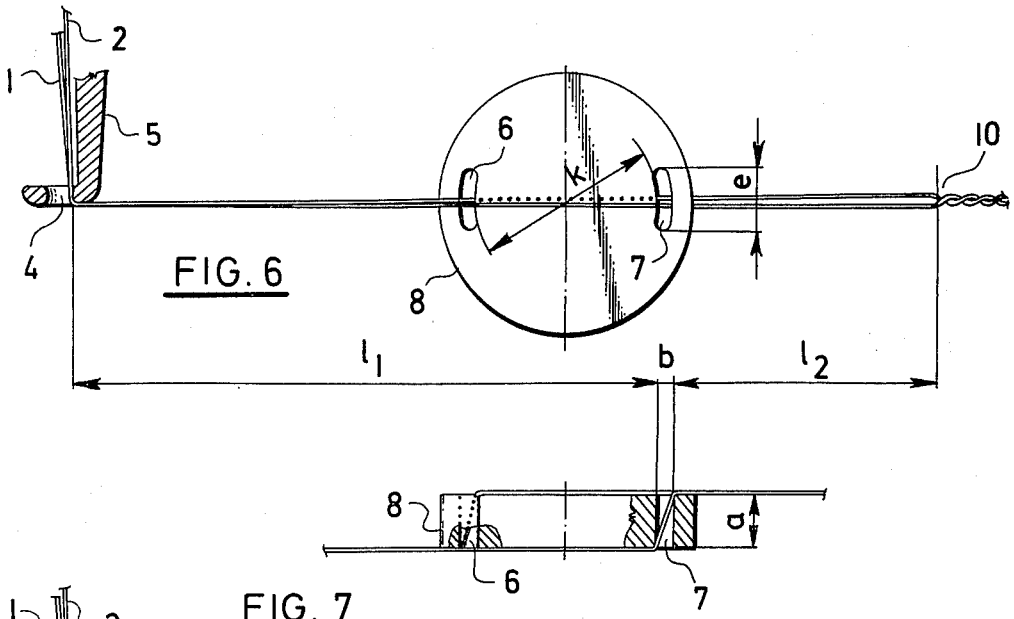
FIG. 6
FIG. 7
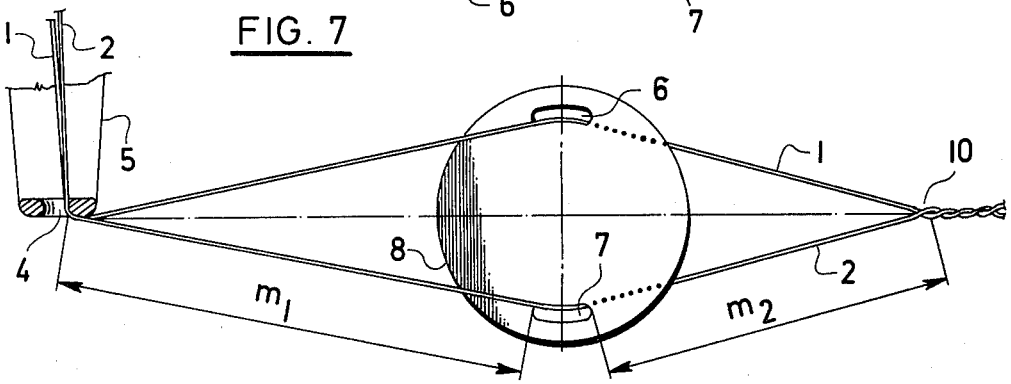
FIG. 8
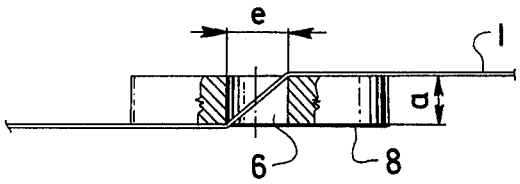
FIG. 9
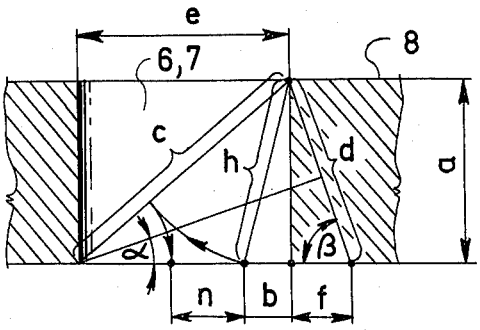
FIG. 11
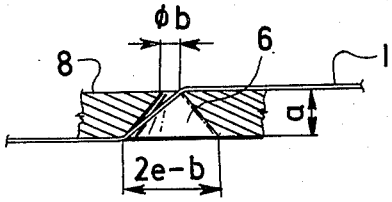
FIG. 10

DEVICE FOR COMPENSATING THE LENGTH OF BINDING THREADS IN A ROTARY SHEDDING DEVICE

The present invention relates to a device for compensating the length of binding threads in a rotary thread entangling device used for the reinforcement of a fabric selvedge by a twisted gauze. Said device is of the type in which the bobbins with the binding threads are spaced from the twisting disc, such disc serving only for forming the shed, the rotation of the disc being synchronized with the rotation of the device in which said bobbins with binding threads are mounted.

One of the problems encountered with rotary thread entangling devices is the compensation of the length of the binding threads. The necessary length of threads between the binding point and the point from which the binding threads are fed to the twisting disc is greater when the shed is opened than when it is closed. This difference in length has hitherto been compensated in most rotary entangling devices by means of various resiliently yieldable elements acting upon the binding threads. Such constructions, however, are not satisfactory and do not provide complete compensation of tension with differing lengths of the binding threads during the opening and closing of the shed as demonstrated by the inferior quality and inferior strength of the fabric selvedges which are reinforced by twisted leno threads.

According to the present invention, the compensation of the binding thread lengths is performed in such manner that at the point of feeding binding threads to the twisting disc there is provided one guiding opening for both binding threads (such guiding opening being possibly separated for each thread individually), two guiding channels being provided in the twisting disc, in the form of a slot arranged symmetrically to the axis of rotation of the twisting disc and situated about the circumference of a circle. The diameter of such circle substantially corresponds to the size of the shed of warp threads at the given distance of the twisting disc from the binding point. The length of the slot of the guiding channels in the twisting disc is determined precisely by calculation in such manner, that the length of the binding threads is constant regardless of whether the shed is opened or closed.

At the point of feeding binding threads through the guiding opening, e.g. at the axis of rotation of the distribution mandrel, as noted above, it is possible to divide a single guiding opening by means of a baffle into two parts in such manner that the two binding threads are separated from each other and are not mutually entangled as e.g. when using binding threads of cotton. The baffle inside the guiding opening may be stationary or movable. The disadvantage of a stationary baffle consists in a certain influencing of the length of binding threads; this, however, is of no great importance upon using certain binding thread materials. The disadvantageous effect of a stationary baffle is reduced when two smaller guiding openings spaced apart the least possible distance are employed.

The advantage of the device according to the present invention consists in that it is possible to achieve by means thereof a perfect compensation of the binding thread length without any further parts and, in most cases, without complicated devices. Also, the abrasion of binding threads on various movable guides is eliminated, and the treatment of the binding threads is improved. This is particularly advantageous when using this device in high-speed looms. Last, but not least, it is also advantageous that the length of the slot in the twisting disc is determined in such manner that when the shed is opened, and the weft thread is entangled by the binding threads at the binding point, the tension of said binding threads is higher than when the shed is closed.

The device according to the present invention is shown in the accompanying drawings, of which:

FIGS. 6–9 are schematic views illustrating the principle of compensating the length of binding threads;

FIG. 10 shows an alternative embodiment of the slot shape of the guiding channel in the twisting disc; and FIG. 11 illustrates graphically the determination of the slot length of the guiding channel in the twisting channel.

In FIG. 11 there are also included the appurtenant symbols used in the formulae for calculating the length of the slot for the theoretical difference in the lengths of the binding threads in the opened and closed shed, given in terms of the size of the slot in the axis of rotation of the twisting disc.

Figure 1:
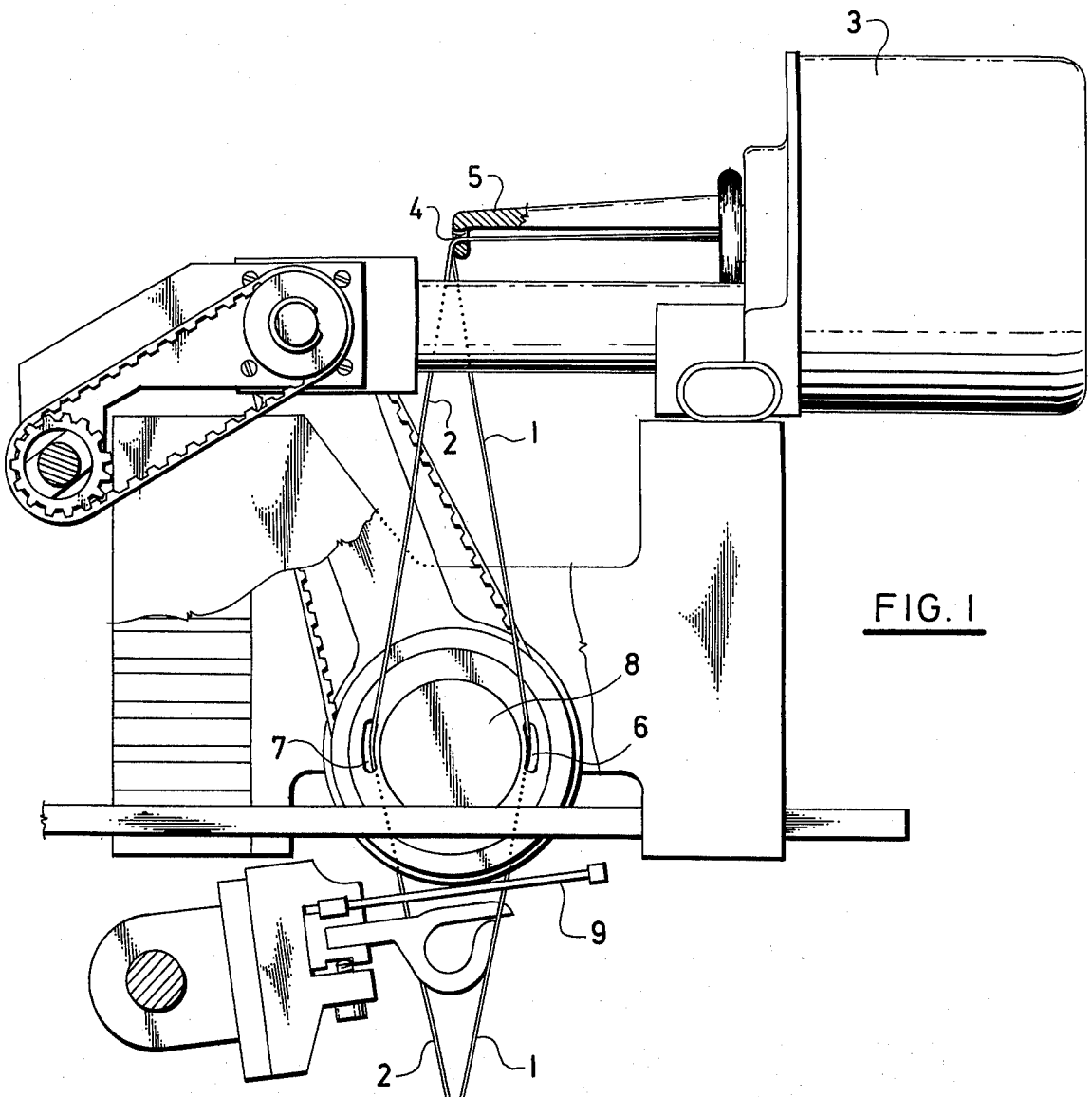
FIG. 1 is an overall side view of the rotary entangling device with a distributing mandrel and a twisting disc.
Figure 2:
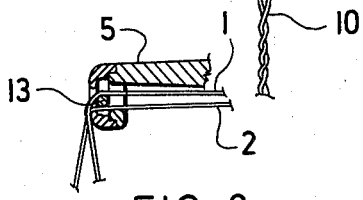
FIGS. 2–5 are detail views of various embodiments of the guiding eyelet in the distributing mandrel.
Figure 3:
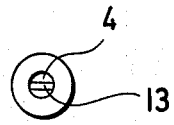
Figure 4:
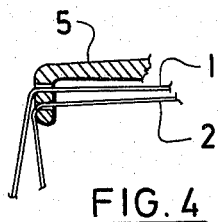
Figure 5:
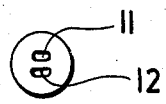

Turning first to FIGS. 6–11, inclusive, the binding threads 1, 2 which are fed from bobbins covered by a housing 3 on the rotary entangling device, are guided through a guiding opening 4 in the distributing mandrel 5 into slot-shaped guiding channels 6, 7 in a rotatable twisting disc 8. The rotation of disc 8 is synchronized with that of the distributing mandrel 5. From the twisting disc 8, the binding threads 1, 2 are guided between the dents of a reed 9 to binding point 10. The guiding opening 4 for both binding threads 1, 2 can be made in the form of a single opening, situated in the axis of rotation of distributing mandrel 5. For binding threads 1, 2 made of certain materials, particularly for those with which entangling is encountered upon their mutual contact, it has been found to be advantageous to use two guiding openings 11, 12 spaced apart a minimum possible distance and in a position symmetrical to the axis of rotation of distributing mandrel 5. Instead of two separated guiding openings 11, 12 it is also possible to use one guiding opening 4 in a form separated e.g. by means of a loosely mounted roller 13 shown in section in FIG. 2 and in front view in FIG. 3. This embodiment has an effect similar to that in the preceding case; it is, however, more advantageous since it does not influence the compensation of the lengths of the binding threads 1, 2 but its manufacture is rather more complicated.

In order to achieve a correct compensation of the length of binding threads when the shed is opened and closed, or to make the length of the binding threads at any position of twisting disc 8 constant, it is assumed that the guiding opening 4 at the point of feeding the binding threads 1, 2 to the twisting disc 8 and the binding point 10 are both stationary, and that the entanglement of weft yarns by twisted leno weave is carried out between them. The length of the slot of the guiding channel in the twisting disc is calculated in such manner as to fulfill the following condition (see FIGS. 6 to 9):

$$l_1 + l_2 + \sqrt{a^2+b^2} = m_1 + m_2 + \sqrt{a^2+e^2}$$

The magnitude of the length compensation $n$ of the binding threads to be achieved upon:

1. The thickness a of twisting disc 8 is given by its construction.
2. The width of slot $b$ (or the diameter $b$) is given by its construction.
3. Angle $\beta$ is calculated.

The length $h$ of the binding thread passing through the guiding channel during the time at which the shed is closed is given by the equation:

$$h = \sqrt{a^2+b^2}.$$

The section $f$ is obtained by subtracting the width of guiding channel $b$ and the theoretical difference in length of binding threads from $h$:

$$f = H - (b+n)$$

The magnitude of the hypotenuse $d$ with a section $f$ and the width of twisting disc a are given by the equation $$d = \sqrt{a^2+f^2}$$

The calculation of angle:

$$\sin(90-\beta) = f/d = \sin\alpha = (d/2/c)$$

The length of the binding thread passing through the channel during the time at which the shed is opened:

$$c = (d/2\sin\alpha)$$

The calculation of the length of slot $e$ in twisting disc 9 (see FIG. 11):

$$e = c - f = \frac{d}{2\sin\alpha} - [h-(b+n)] =$$

$$\frac{\sqrt{a^2+f^2}}{-2\sin\alpha} - [h-(b+n)] =$$

$$\frac{\sqrt{a^2+[h-(b+n)]^2}}{2\sin\alpha} - \left[\sqrt{(a^2+b^2)} - (b+n)\right] =$$

$$\frac{\sqrt{a^2+[(a^2+h^2)-(b+n)]^2}}{2\sin\alpha} - \left[\sqrt{(a^2+b^2)} - (b+n)\right]$$

In view of the fact that the provision of the guiding channels 6, 7 in the twisting disc 8 in form of a slot reduces the shed at certain phases of rotation of the twisting disc 8, it is then possible to use the alternative solution of the shape of the slots shown in FIG. 10, which guarantees the same course of forming the shed of binding threads as in all rotary entangling devices hitherto used. According to the alternative embodiment of FIG. 10 in the twisting disc, at the side of feeding the binding threads to the binding point 10, guiding channels of the necessary diameter are provided, such channels through the thickness a of twisting disc 8 symmetrically widening to the dimension $2e - b$ at the opposite side of twisting disc 8. Thus, compensation of the lengths of the binding threads according to the present invention is secured, as well as correct forming of the shed. According to previous experience, however, it is not necessary to use this alternative, as it is more complicated from the viewpoint of manufacture.

During operation of the loom, the twisting disc 8 is rotated at half the speed of the loom and the binding threads 1, 2 entangle the separate weft threads which are successively inserted into the shed. In view of the fact that the length of the slot of guiding channels 6, 7 is determined by calculation in such manner as to correspond to the theoretical difference in length of binding threads 1, 2 with opened and closed shed, an absolutely "constant" compensation is achieved without the use of any resilient members which are usually interposed in the path of the binding threads.

The compensation of the length of binding threads according to the present invention makes possible a broader application of rotary entangling devices in modern looms, even when such looms operate at very high speed.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. In an apparatus for forming a leno-type selvedge at a fixed binding point of a weaving loom, a shed-forming twisting disc having a fixed axis extending parallel to the direction of weft insertion in the loom, the disc exhibiting a pair of diametrically opposed elongated arcuate slots extending axially therethrough and in coaxial relation to the disc axis, strand means supported on the loom for paying off a pair of binding threads to the common binding point through individual ones of the arcuate slots on the disc to define a selvedge shed, the strand supply means having a common thread exit aperture disposed in a common plane with the fixed binding point and the axis of the disc, and means for rotating the disc about its axis in a fixed direction to cyclically open and close the selvedge shed.

2. Apparatus as defined in claim 1, in which the fixed arcuate length $e$ of the arcuate slots is chosen so that $$l_1 + l_2 + \sqrt{a^2+b^2} = m_1 + m_2 + \sqrt{a^2+e^2}$$

where $a$ is the diameter of the disc, $b$ is the width of the arcuate slots, $l_1$ is the distance between the common thread exit aperture and the wall nearest thereto of the arcuate slot most remote therefrom when the arcuate slots are aligned in said common plane, $l_2$ is the distance between the common binding point and the wall nearest thereto of said last-mentioned arcuate slot when the arcuate slots are aligned in said common plane, $m_1$ is the distance between the common thread exit aperture and the wall nearest thereto of one of the arcuate slots when the arcuate slots are aligned in a plane perpendicular to said common plane, and $m_2$ is the distance between the fixed binding point and the wall nearest thereto of said last-mentioned arcuate slot when the arcuate slots are aligned in a plane perpendicular to said common plane.

* * * * *